US008388560B2

(12) United States Patent
Jian et al.

(10) Patent No.: US 8,388,560 B2
(45) Date of Patent: Mar. 5, 2013

(54) ROLLING MASSAGER WITH THERMAL ENHANCEMENT

(76) Inventors: Ding Jian, Dublin, CA (US); Megan Zhu, Dublin, CA (US)

( * ) Notice: Subject to any disclaimer, the term of this patent is extended or adjusted under 35 U.S.C. 154(b) by 265 days.

(21) Appl. No.: 12/930,387

(22) Filed: Jan. 4, 2011

(65) Prior Publication Data

US 2012/0172771 A1 Jul. 5, 2012

(51) Int. Cl.
*A61H 1/00* (2006.01)

(52) U.S. Cl. ..... 601/15; 601/46; 601/70; 601/118; 601/121

(58) Field of Classification Search ..... 601/15, 601/19, 22, 46, 48, 49, 50, 52, 53, 54, 56, 601/57, 60, 63, 64, 65, 67, 69, 70, 72, 73, 601/80, 84, 86, 87, 89, 90, 93, 94, 95, 97, 601/98, 99, 101, 102, 107, 108, 111, 115, 601/118, 119, 120–130, 134, 135, 136, 137
See application file for complete search history.

(56) References Cited

U.S. PATENT DOCUMENTS 4,878,489 A * 11/1989 Kamayachi ..... 601/72
5,123,406 A * 6/1992 Masuda ..... 601/72
5,143,056 A * 9/1992 Yih-Jong ..... 601/118
5,411,470 A * 5/1995 Liptak et al. ..... 601/118
6,764,456 B1 * 7/2004 Doherty ..... 601/121
7,112,178 B1 * 9/2006 Roozenburg ..... 601/15
2009/0247915 A1 * 10/2009 Imboden et al. ..... 601/70

* cited by examiner

*Primary Examiner* — Quang D Thanh
(74) *Attorney, Agent, or Firm* — Jew & Associates; Leon Emmanuel Jew

(57) ABSTRACT

A massager device providing multiple massaging effects with thermal enhancement is disclosed. The device comprises a cylindrical body with a first end which is closed and a second end which is open, a first cap coupled to the first end, and a second cap coupled to the second end, an assembly of DC vibrator embedded in the first end, and a switch embedded in the first cap. The cylindrical body comprises an inner layer and an outer layer. The inner layer is made of ABS materials. The outer layer is made of silicone rubber and comprises a base sheet and an array of evenly spaced identical elastic nipples positioned outwardly with their bottoms embedded in the base sheet. The first cap and the second cap have substantially identical exterior shape and size, each of which having an inner layer made of ABS materials and a silicone rubber ring coupled to the inner layer's exterior. The hollow space made by the cylindrical body and the second cap may contain thermal media such as water or gel. In operation, the user may enjoy massaging effects from the silicone rubber nipples, the silicone rubber rings on the both ends, as well as the high temperature or lower temperature controlled by the thermal media contained in the hollow space.

9 Claims, 5 Drawing Sheets

ROLLING MASSAGER WITH THERMAL ENHANCEMENT

FIELD OF THE INVENTION

The present invention relates to a massager device, and more particularly to a massager device capable of providing multiple massaging effects with thermal enhancement.

BACKGROUND OF THE INVENTION

Massager devices for therapeutic and recreational uses are well known in the art. In various circumstances, the massager devices may be used in combination with the applications of acupressure, compress, hot compress or cold compress during a massage. However, such a simultaneous operation requires the user to manage the massager device, the thermal means and the acupressure means at the same time which could be cumbersome. Therefore, there is a need in the art for a massager device that provides multiple massaging effects with thermal enhancement.

SUMMARY OF THE INVENTION

The present invention discloses and teaches a massager device capable of providing multiple massaging effects with thermal enhancement. The device comprises a cylindrical body with a first end which is closed and a second end which is open, a first cap which can be operatively coupled to the first end, and a second cap which can operatively coupled to the second end, an assembly of DC vibrator embedded in the first end, and a mechanical switch button embedded in the first cap. The cylindrical body comprises an inner layer and an outer layer. The inner layer is made of ABS materials with properties of good heat conduction. The outer layer is made of silicone rubber and comprises a cylindrical base and an array of evenly spaced identical elastic nipples positioned outwardly with their bottoms embedded in the cylindrical base. The first cap and the second cap have substantially identical exterior shape and size, each of which having an inner layer made of ABS materials and a silicone rubber ring coupled to the inner layer's exterior. The hollow space, defined by the cylindrical body and the second cap, may contain thermal media such as water or gel. In operation, the user may enjoy massaging effects from the silicone rubber nipples, the silicone rubber rings on the both ends, as well as the high temperature or low temperature provided by the thermal media contained in the hollow space.

DESCRIPTION OF THE INVENTION

Figure 1:
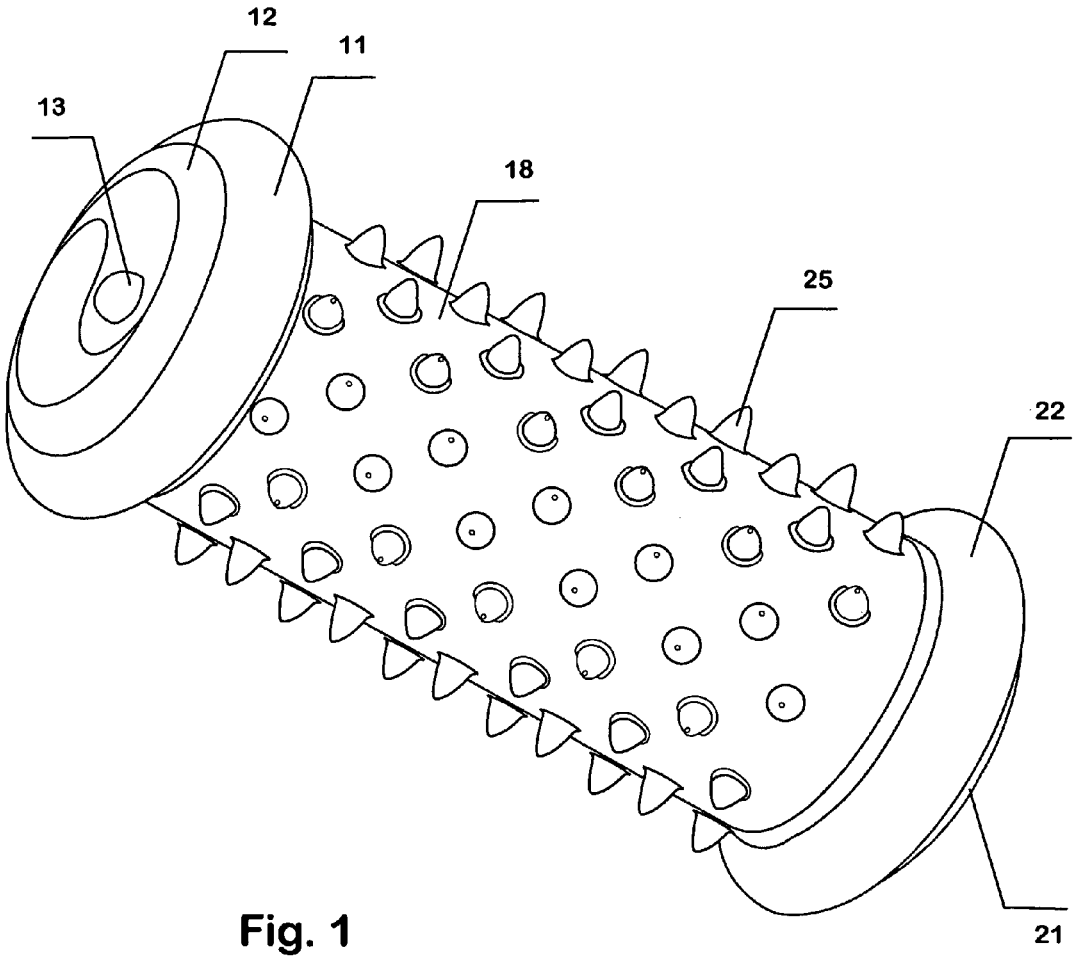
FIG. 1 is a diagram illustrating a perspective view of a rolling massager according to the present invention.

While the present invention may be embodied in many different forms, shapes, designs or configurations, for the purpose of promoting an understanding of the principles of the invention, reference will be made to the embodiments illustrated in the drawings and specific language will be used to describe the same. It will nevertheless be understood that no limitation of the scope of the invention is thereby intended. Any alterations and further implementations of the principles of the invention as described herein are contemplated as would normally occur to one skilled in the art to which the invention relates.

Figure 1A:
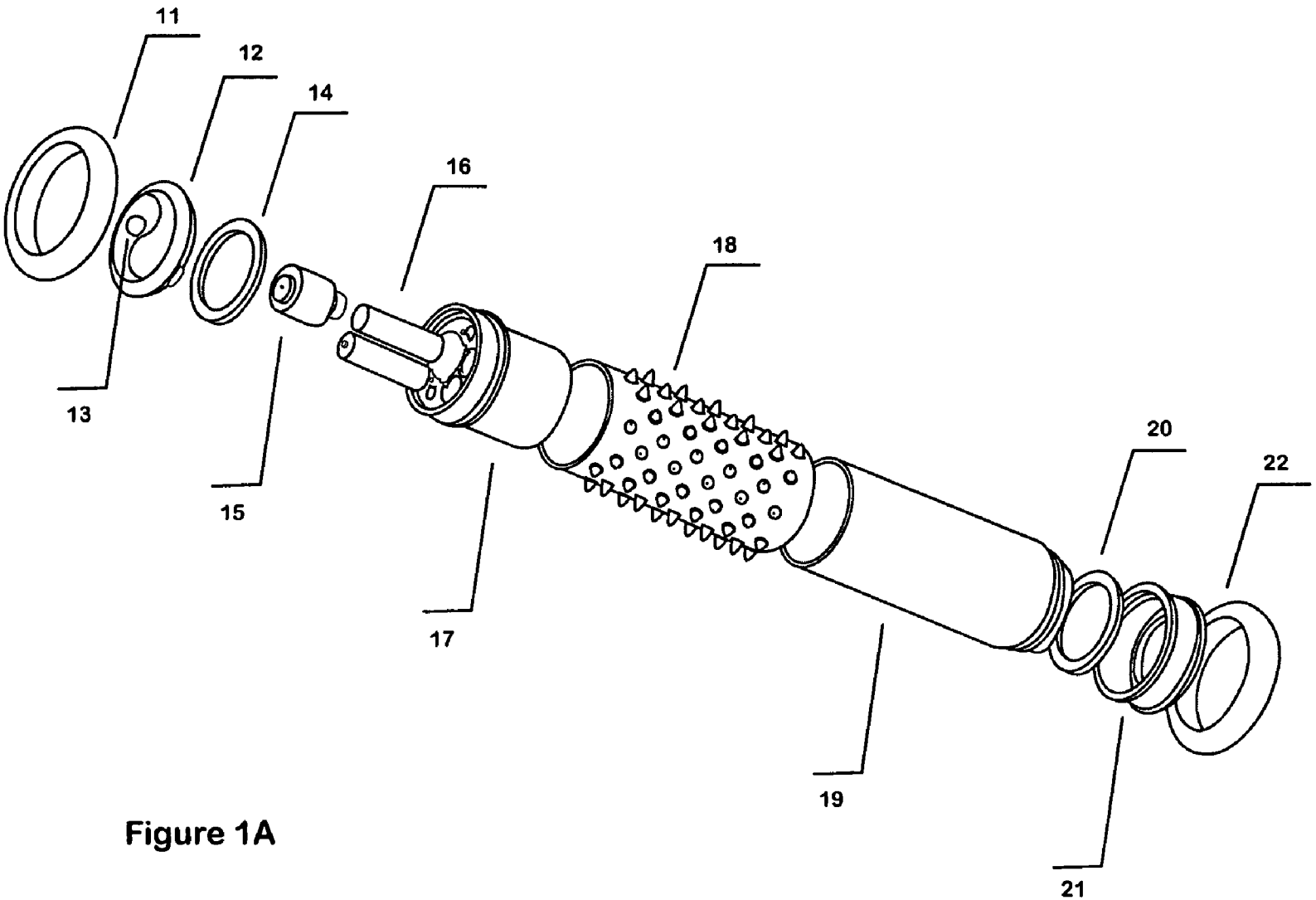
FIG. 1A is a diagram illustrating an explosive view of the rolling massager of FIG. 1.
Figure 2:
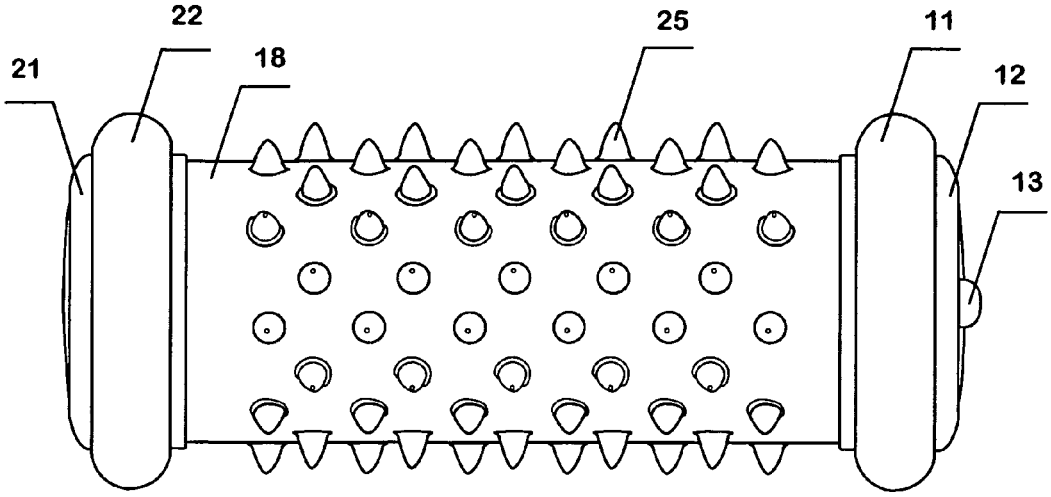
FIG. 2 is a diagram illustrating a plain front view of the rolling massager of FIG. 1.

FIG. 1 illustrates a perspective view of a rolling massager according to the present invention. FIG. 1A illustrates an explosive view of the rolling massager of FIG. 1. FIG. 2 illustrates a plain front view of the rolling massager of FIG. 1. The rolling massager device includes a cylindrical body, an electric-powered vibrator assembly embedded in the body's first end, a first cap operatively coupled to the first end, a second cap operatively coupled to the second end. In particular, the massager body includes an inner layer 19 and an outer layer 18. The outer layer 18 is annularly coupled to the inner layer 19. The first end of the massager body is the end where the electric-powered vibrator assembly is installed or embedded. The electric-powered vibrator assembly includes a vibrator 17, a power source such as a pair of AA size battery 16, and an electrical switch 15 for controlling the vibrator 17. In a typical embodiment, the vibrator 17 includes a DC motor using 3~4.5 voltage DC power with a rotating speed of 6000 RPM. Optionally, a first sealing ring 14 is used between the first cap body 12 and the vibrator 17. In the other end of the massager body, a second cap is to be operatively coupled. The second cap includes a second cap body 21 and a silicone rubber ring 22. Optionally, a second sealing ring 20 is used between the second cap body 21 and the inner layer 19.

Figure 3:
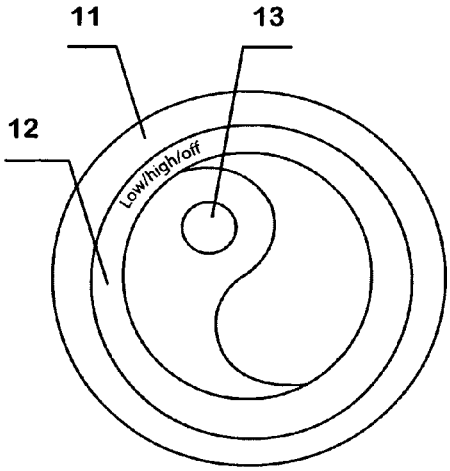
FIG. 3 is a diagram illustrating a right side-view of the rolling massager of FIG. 2, i.e. the first cap of rolling massager of FIG. 2.

FIG. 3 illustrates a right side view of the rolling massager of FIG. 2, i.e. the first cap of rolling massager of FIG. 2. Referring to FIG. 1A and FIG. 3, the first cap includes a cap body 12, a silicone rubber ring 11 annularly coupled to the cap body 12, and a mechanical switch button 13. When the first cap of FIG. 3 is operatively coupled to the inner layer 19 of the cylindrical body, the mechanical button 13 is operatively engaged with the electrical switch 15. By pressing the mechanical button 13, the user may control the operation modes of the rolling massager such as ON, OFF, HIGH, and LOW.

Figure 4:
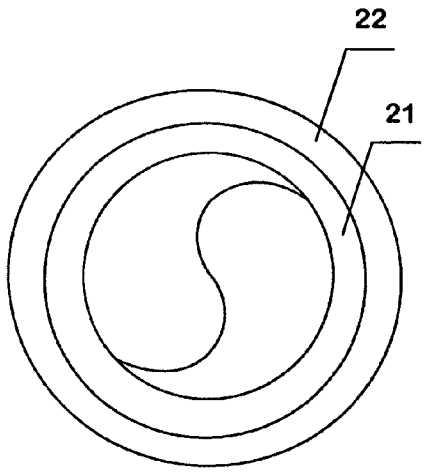
FIG. 4 is a diagram illustrating a left side-view of the rolling massager of FIG. 2, i.e. the second cap of the rolling massager of FIG. 2.

FIG. 4 is a diagram illustrating a left side view of the rolling massager of FIG. 2, i.e. the second cap of the rolling massager of FIG. 2. Referring to FIG. 1A and FIG. 4, the second cap includes a cap body 21 and a silicone rubber ring 22 annularly coupled to the cap body 21. In the most preferred embodiment, the silicone rubber ring 11 and the silicone rubber ring 22 are identical.

Figure 5:
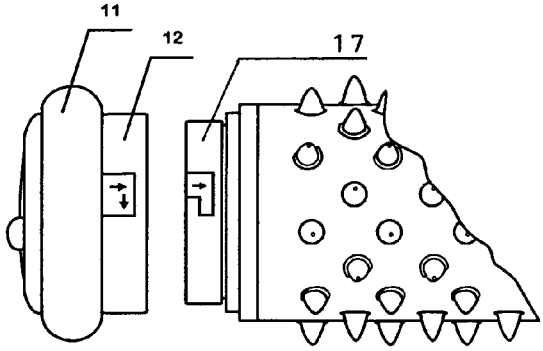
FIG. 5 is a schematic diagram illustrating a typical coupling mechanism between the body of the first cap and the first end of the massager device body.
Figure 5A:
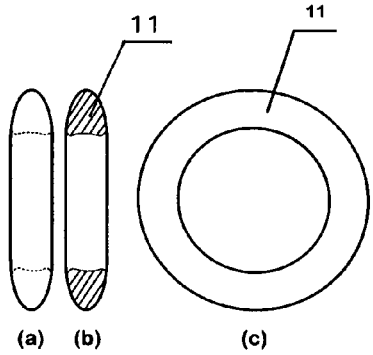
FIG. 5A is a diagram illustrating (a) a side view, (b) cross sectional view, and (c) a front view of the silicone rubber ring to be coupled to the first cap's body.

FIG. 5 schematically illustrates a typical coupling mechanism between the first cap's body 12 and the first end of the rolling massager. As mentioned above, the first end of the massager body is the end where the electric-powered vibrator assembly is installed or embedded. In a typical operation, the user first inserts the massager's first end into the cap body 12, and then turns the cap body 12 to lock it. After the first cap is locked, the rubber ring 11 is sleeved over the exterior of the cap body 12 as shown in FIG. 1 and FIG. 2. FIG. 5A is a diagram illustrating (a) a side view, (b) a side cross sectional view, and (c) a front view of the silicone rubber ring 11 to be coupled to the first cap's body 12. The coupling mechanism between the cap body 12 and the massager body can be an insert-and-turn lock, an insert lock or any other lock means.

Figure 6:
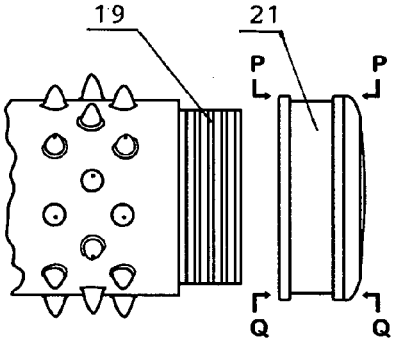
FIG. 6 is a schematic diagram illustrating a typical coupling mechanism between the body of the second cap and the second end of the massager device body.
Figure 6A:
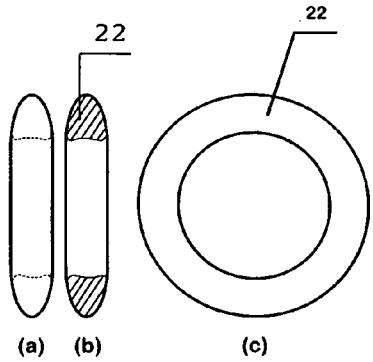
FIG. 6A is a diagram illustrating (a) a side view, (b) cross sectional view, and (c) a front view of the silicone rubber ring to be coupled to the second cap's body.
Figure 6B:
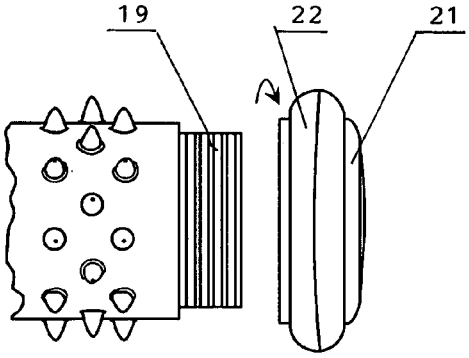
FIG. 6B is a schematic diagram illustrating a turning-in coupling mechanism between the second cap and the second end of the massager body.
Figure 6C:
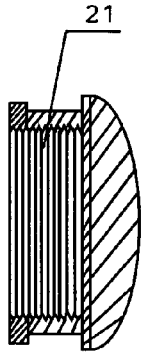
FIG. 6C is a diagram illustrating a PP-QQ cross sectional view of the body of the second cap of FIG. 6.

FIG. 6 illustrates a typical coupling mechanism between the body 21 of the second cap and the second end of the massager body. FIG. 6A shows (a) a side view, (b) a side cross sectional view, and (c) a front view of the silicone rubber ring 22 to be coupled to the second cap's body. FIG. 6B illustrates a turn-in style coupling mechanism between the second cap and the second end of the massager body. The coupling mechanism between the second cap body and the massager body can be an insert-and-turn lock, an insert lock or any other lock means such as screwing-in using helical thread. To avoid leaking of liquid, the most preferred coupling means is helical thread as illustrated in FIG. 6, FIG. 6B, FIG. 6C, and FIG. 6D. In a typical operation, the user put thermal media such as hot water, or cold water, or a bag of gel into the hollow space of the massager body, then screw in the second cap. Due to heat conduction, the outer layer 18 of the massage body has the similar thermal property as the thermal media therein. Optionally, a sealing ring may be used between the massage body and the second cap.

Figure 7A:
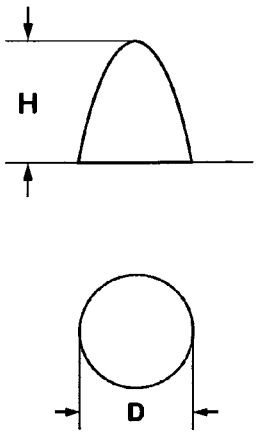
FIGS. 7A, 7B and 7C are diagrams illustrating three different shapes of the nipples used in the massager device.
Figure 7B:
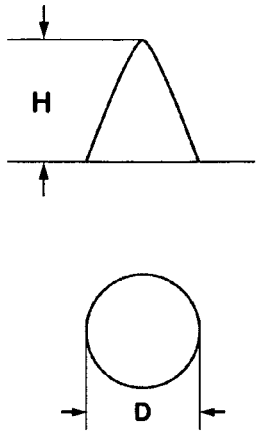
Figure 7C:
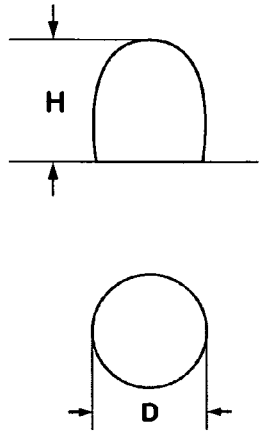

Referring back to FIG. 1 and FIG. 2, the nipples 25 embedded in the cylindrical base 18 may be in a tapered shape as illustrated in FIG. 7A and FIG. 7B, or a grape shape as illustrated in FIG. 7C. Preferably, the ratio of the diameter of the nipple's bottom ("D") to the height of the nipple ("H") ranges from 1:1.5 to 1:2.0.

In terms of the hollow space defined by the inner layer 19 of the massager body, the first end of the massager body is closed, i.e. sealed to avoid leaking. In other words, when the vibrator assembly is installed in the massager body, the liquid in the hollow space cannot be leaked in to the first end. The second end of the massager body is open and can be sealed by the engagement of the second cap. When the second cap is operatively coupled to the second end of the massager body either by a helical thread coupling means or by an insert and lock means, a sealed hollow space is defined. The hollow space is used to store thermal media such as hot water or cold water. In an alternative embodiment, microwavable and freezable gel sealed in a flexible bag can be used as the thermal media. If the user prefers a warm or hot massaging effect, she just simply warms up the gel using a microwave. Similarly, if the user prefers a chilly massaging effect, she just simply cools down the gel using a refrigerator.

The inner layer 19 of the massager body is made of ABS (Acrylonitrile-Butadiene-Styrene) materials. It conducts heat efficiently. Its physical property maintains stable at a temperature lower than 200° C. ABS is group of tough, rigid thermoplastics derived from the reaction of acrylonitrile, styrene, and butadiene gas. These materials are polymerized together in a variety of ratios to produce ABS resins.

The outer layer 18 includes a plurality of identical nipples which are evenly spaced and outwardly positioned having their bottoms embedded in a cylindrical base with a thickness ranging from 1.5 to 3 mm. The nipples are elastic. In other words, they are capable of returning to its original length, shape, etc., after being stretched, deformed, compressed, or expanded. Preferably, the ratio of the thickness of the cylindrical base to the height of the nipple ranges from 1:6 to 1:10. The distance between every two adjacent nipples is 1.5-3 times of the diameter of the nipple's bottom. The cylindrical base and the nipples are made of silicone rubber. Silicone rubber is a rubber-like material composed of silicone—itself a polymer—containing silicon together with carbon, hydrogen, and oxygen. Silicone rubber is generally non-reactive, stable, and resistant to extreme environments and temperatures from −55° C. to +300° C. while still maintaining its useful properties. During manufacture heat may be required to vulcanize (set or cure) the silicone into its rubber-like form. This is normally carried out in a two stage process at the point of manufacture into the desired shape, and then in a prolonged post-cure process. It can also be injection molded. Silicone rubber offers good resistance to extreme temperatures, being able to operate normally from −55° C. to +300° C. At the extreme temperatures, the tensile strength, elongation, tear strength and compression set can be far superior to conventional rubbers although still low relative to other materials. Silicone rubber is a highly inert material and does not react with most chemicals.

The advantages of this invention are numerous. For examples: (1) it is portable and easy to carry; (2) simultaneous applications of acupressure and massaging affects by the silicone rubber nipples and the silicone rubber rings with hot or cold compressing.

While one or more embodiments of the present invention have been illustrated above, the skilled artisan will appreciate that modifications and adoptions to those embodiments may be made without departing from the scope and spirit of the present invention.

The invention claimed is:

1. A massager device providing multiple massaging effects with thermal enhancement, comprising:

a cylindrical body with a first end which is sealed and a second end which is open;

an assembly of DC vibrator embedded in said first end for providing electric-powered vibrations, a first cap operatively coupled to said first end;

a switch button embedded in said first cap; and a second cap operatively coupled to the second end;

wherein said cylindrical body comprises an outer layer which is annularly coupled to an inner layer, said inner layer being made of ABS materials, and said outer layer being made of silicone rubber and comprising a cylindrical base and an array of evenly spaced identical elastic nipples positioned outwardly with their bottoms embedded in said cylindrical base;

wherein said first cap and said second cap have substantially identical exterior shape and size, each of which having an inner body made of ABS materials and a silicone rubber ring annularly coupled to said inner body's exterior; and wherein said cylindrical body and said second cap defines a hollow space for containing thermal media; and wherein when said first cap is coupled to said first end of said cylindrical body, said switch button is mechanically engaged with an electrical switch of said assembly such that said assembly may be controlled by pressing said button.

2. The massage device of claim 1, wherein said first cap is operatively coupled to said first end of said cylindrical body by an insert-and-turn lock.

3. The massage device of claim 1, wherein said second cap is operatively coupled to said second end of said cylindrical body by any of: an insert-and-turn lock, an insert lock, and helical threads.

4. The massage device of claim 1, wherein said thermal media is any of: hot water, cold water, a flexible and replaceable container for containing microwavable and freezable gel.

5. The massager device of claim 1, wherein a distance between every two adjacent nipples is 1.5-3 times of a nipple's bottom diameter.

6. The massager device of claim 1, wherein a ratio of said cylindrical base's thickness to said nipples' height ranges from 1:6 to 1:10.

7. The massager device of claim 1, wherein a ratio of said nipples' bottom diameter to said nipples' height ranges from 1:1.5 to 1:2.

8. The massager device of claim 1, further comprising a sealing ring coupled between said second end and said second cap.

9. The massager device of claim 1, wherein said cylindrical base's thickness is ranges from 1.5 to 3 mm.

* * * * *